US005390915A

United States Patent [19]

Levatino

[11] Patent Number: 5,390,915

[45] Date of Patent: Feb. 21, 1995

[54] BASEBALL BATTING TRAINING MACHINE

[76] Inventor: Samuel R. Levatino, 3608 Woodland Ridge Blvd., Baton Rouge, La. 70816

[21] Appl. No.: 130,791

[22] Filed: Oct. 4, 1993

Related U.S. Application Data

[60] Continuation-in-part of Ser. No. 49,113, Apr. 19, 1993, Pat. No. 5,318,291, which is a division of Ser. No. 863,087, Apr. 3, 1992, Pat. No. 5,226,646, which is a continuation-in-part of Ser. No. 824,526, Jan. 23, 1992, Pat. No. 5,228,684.

[51] Int. Cl.[6] ..... A63B 69/40

[52] U.S. Cl. ..... 273/26 R

[58] Field of Search ..... 273/26 R, 29 A, 191 R, 273/192, 186 A, 193 A, 193 B, 26 E; 280/842

[56] References Cited

U.S. PATENT DOCUMENTS

| | | | |
|---|---|---|---|
| 3,134,451 | 10/1938 | Morgen | 273/26 E |
| 3,953,035 | 4/1976 | Beckisk | 273/192 |
| 4,043,991 | 7/1977 | Oppenheimer | 273/186 A |
| 4,133,535 | 1/1979 | Marsh | 273/192 |
| 4,334,684 | 6/1982 | Sterling | 273/192 |
| 4,577,862 | 3/1986 | Segedahl | 273/26 R |
| 4,592,545 | 6/1986 | Segedahl | 273/26 R |
| 4,842,270 | 6/1989 | Lange | 273/29 A |
| 5,074,565 | 12/1991 | Tucker | 273/192 |

*Primary Examiner*—Theatrice Brown

*Attorney, Agent, or Firm*—Reginald F. Roberts, Jr.

[57] ABSTRACT

A training machine for baseball, lawn tennis, table tennis, badminton, racquet ball, handball, and the like. The machine has a frame on which is mounted a kinetic adapter. The adapter includes a linear bearing slidably and rotatably mounted on a stationary shaft, a second shaft fastened to the bearing and perpendicular to the horizontal shaft, and a ball rotatably connected to one end of the second shaft. A training bat is connected at one end to the ball, with the other end of the bat providing a handle. The kinetic adapter provides for the training bat freedom of movement, both linear and rotational, in three dimensions and an infinite number of planes.

5 Claims, 4 Drawing Sheets

BASEBALL BATTING TRAINING MACHINE

CROSS-REFERENCES TO RELATED APPLICATIONS

This is a continuation-in-part of application Ser. Pat. No. 49,113, filed Apr. 19, 1993, now U.S. Pat. No. 5,318,291, which is a division of application Ser. No. 863,087, filed Apr. 3, 1992, now U.S. Pat. No. 5,226,646, which is a continuation-in-part of application Ser. No. 824,526, filed Jan. 23, 1992, now U.S. Pat. No. 5,228,684. Said patents and application are hereby incorporated by reference.

BACKGROUND OF THE INVENTION

The present invention relates to a training device. More particularly, the present invention relates to a mechanical device for training an individual to swing and bit a baseball, tennis ball, or the like with a baseball bat, tennis racquet, or the like.

At present the training available for properly and expertly batting a baseball or tennis ball is restricted to either manual instruction or mechanical devices which are constructed and designed to teach by rote memory or by trial and error. There does not exist in the prior art any device which allows the trainee to actually feel the way he or she should swing a baseball bat or tennis racquet for maximum advantage. But it is virtually impossible to teach the trainee efficiently by either prior-art method. What is needed is a device which will simulate the ideal swing, and which will simultaneously communicate this simulation as a feeling to the trainee. The present invention provides such a machine.

SUMMARY OF THE INVENTION

In general, the present invention in one aspect provides a kinetic adapter. The kinetic adapter is mounted on a stationary shaft, and provides freedom of movement for a rigid, elongated member.

The kinetic adapter comprises a linear bearing which is slidably and rotatably mounted on the stationary shaft, a second shaft, and a spherical member. The second shaft has a first end fastened to the linear bearing, and a second end connected to the spherical member. The stationary shaft and the second shaft are substantially perpendicular to one another. A first end of the rigid elongated member is rotatably connected to the spherical member. A second end of the rigid, elongated member is free, to serve as a handle for grasping and moving the rigid, elongated member.

The stationary shaft, the linear bearing, the second shaft, the spherical member, and the rigid, elongated member are so constructed and arranged that the combination thereof provides for the rigid, elongated member freedom of movement, both linear and rotational, in three dimensions and in an infinite number of planes.

In a second aspect the invention provides a training machine for baseball, lawn tennis, table tennis, badminton, racquetball, handball and the like. The training machine comprises a frame; an entirely straight, rigid, substantially horizontal member mounted on the frame; a linear bearing mounted on the elongated horizontal member; and a training bat having first and second ends. The first end of the bat serves as a bathead, and the second end of the bat serves as a handle. The machine further comprises means for constructing and arranging the linear bearing and the bat so that the bathead is constrained by the linear bearing to move in an entirely straight path when the bat is swung.

The linear bearing and the horizontal member are constructed and arranged so that the bearing can move linearly along the horizontal member and rotatably around the horizontal member. The rotation of the linear bearing around the horizontal member defines an axis of rotation. The straight horizontal member and the linear bearing mounted thereon provide a constrained, entirely straight path for movement of the linear bearing.

DETAILED DESCRIPTION OF THE INVENTION

Figure 1:
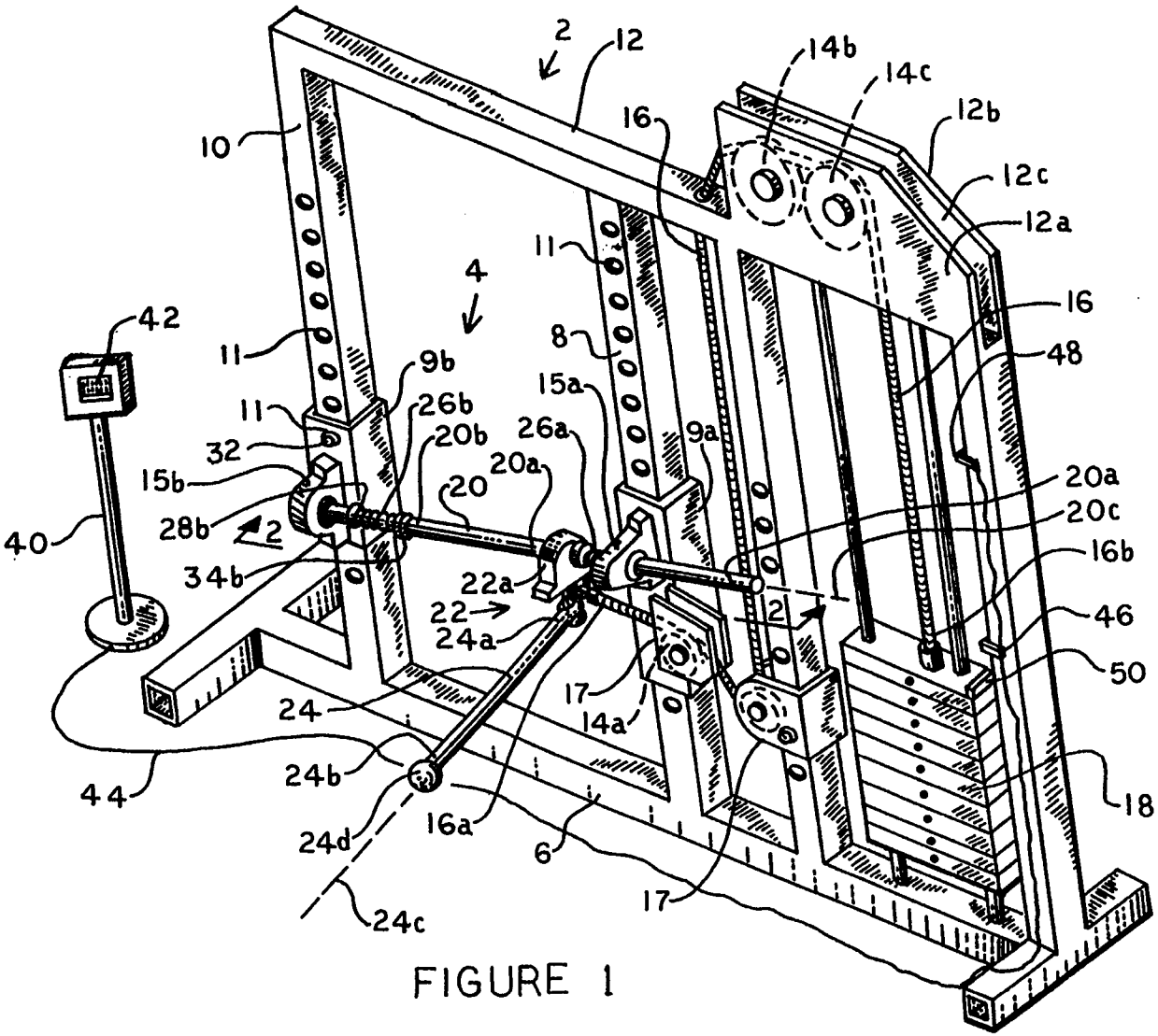
FIG. 1 is a schematic representation of a baseball training machine made in accordance with the principles of the present invention.
Figure 2:
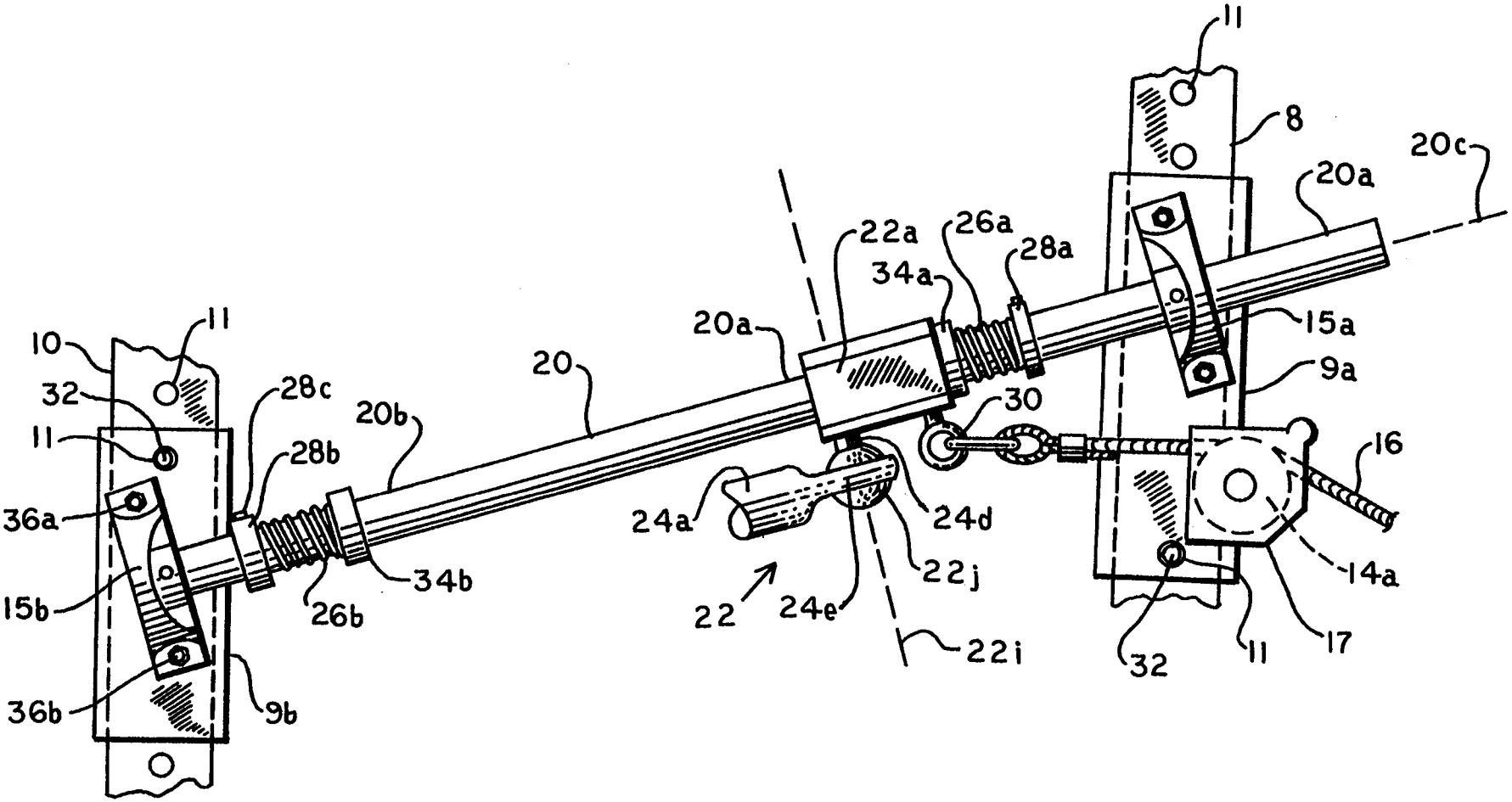
FIG. 2 is a partial cross-sectional view of the machine shown in FIG. 1, taken along the cutting line 2—2.

More specifically, reference is made to FIGS. 1 and 2, in which is shown a training machine for baseball, lawn tennis, table tennis, badminton, racquetball, handball and the like, made in accordance with the principles of the present invention, and generally designated by the numeral 2.

The training machine 2 includes a frame 4 having a horizontal base 6, first and second perforated vertical members 8 and 10, and a horizontal arm 12.

First and second perforated sheaths **9*a* and 9*b* surround the first and second vertical members 8 and 10 over part of the lengths of the vertical members. Perforations 11 in the vertical members 8 and 10 are alignable with perforations 11 in the sheaths 9*a* and 9*b*, whereby the sheaths 9*a* and 9*b*** can be fixed at a particular elevation, as hereinafter explained.

First and second flexible pillow block bearings **15*a* and 15*b* are fastened to the first and second sheaths 9*a* and 9*b*. An adjustable elongated, entirely straight, and rigid cross-member 20 has first and second ends 20*a* and 20*b* which define a longitudinal axis 20*c*. The adjustable cross-member 20 is preferably cylindrical. The first end 20*a* of the adjustable cross-member 20 is disposed in and supported by the first pillow block bearing 15*a*; the second end 20*b* of the adjustable cross-member 20 is disposed in and supported by the second pillow block bearing 15*b***.

First, second, third, and fourth annular stop members **28*a*, 28*b*, 34*a*, and 34*b*, respectively, and first and second springs 26*a*, 26*b* are mounted on the adjustable cross-member 20. The first and second springs 26*a* and 26*b* are disposed between and fastened to the first and third stop members 28*a*, 34*a* and the second and fourth stop members 28*b*, 34*b*, respectively. Between the third and fourth stop members 34*a* and 34*b*, a kinetic adapter 22 is slidably and rotatably mounted on the cross-member 20. A training bat comprising a rigid, elongated member 24 having first and second ends 24***a*, 24*b* communicates with and is constrained by the kinetic adapter 22. The first end 24*a* of the training bat 24 is attached to the kinetic adapter 22 and serves as a bathead, and the second end 24*b* of the training bat 24 serves as a handle for the bat 24. A knob 24*d* of rubber or the like protects the second end 24*b* of the training bat 24 from slipping. The first and second ends 24*a* and 24*b* define a longitudinal axis 24*c* of the training bat 24. The training bat 24 is preferably cylindrical.

A cable 16 having first and second ends 16*a*, 16*b* is disposed in first, second, and third frictionless pulleys 14*a*, 14*b*, 14*c*, respectively. The first pulley 14*a* is mounted on the first sheath 9*a*; the second and third pulleys 14*b* and 14*c* are mounted on parallel vertical plates 12*a*, 12*b* which define therebetween a slot 12*c* in which the pulleys 14*b* and 14*c* are disposed. The first end 16*a* of the cable 16 is secured to a linear bearing 22*a* having an opening therein extending therethrough by a pair of interlocking rings 30. One of the pair of rings 30 is fastened to the linear bearing 22*a*, and the other ring of the pair 30 engages a loop at the end 16*a* of the cable 16. An adjustable weight 18 is attached to the second end 16*b* of the cable 16.

The pillow block bearings 15*a* and 15*b* are fastened to the sheaths 9*a* and 9*b* by nuts 30*a* and bolts 30*b*. The stop members 28*a* and 28*b* are secured to the adjustable cross-member 20 by Allen screws 28*c* which, when loosened, allow the members 28*a* and 28*b* to slide along the cross-member 20 and be refastened at any point along the cross-member.

A battery-powered electrical timer 42 is mounted on a stand 40. It is to be understood that, instead of a battery (not shown), any other suitable source of electrical power, such as, for example, an alternating-current (AC) or direct-current (DC) electrical outlet, could be used. An electrical cord 44 provides an electrical connection between the battery (not shown), timer 42, and first and second electromagnetic sensors 46 and 48, respectively. A magnet 50 attached to the variable weight 18 causes a first electrical signal to be emitted when the magnet 50 passes near the first electromagnetic sensor 46, and a second electrical signal to be emitted when the magnet 50 passes near the second electromagnetic sensor 48. The first signal starts the timer., and the second signal stops the timer 42. From the time elapsed, the speed of a swing of the training bat 24 can be calculated. From the value of the variable weight 18 and the elapsed time, the power of the swing can be computed.

Figure 3:
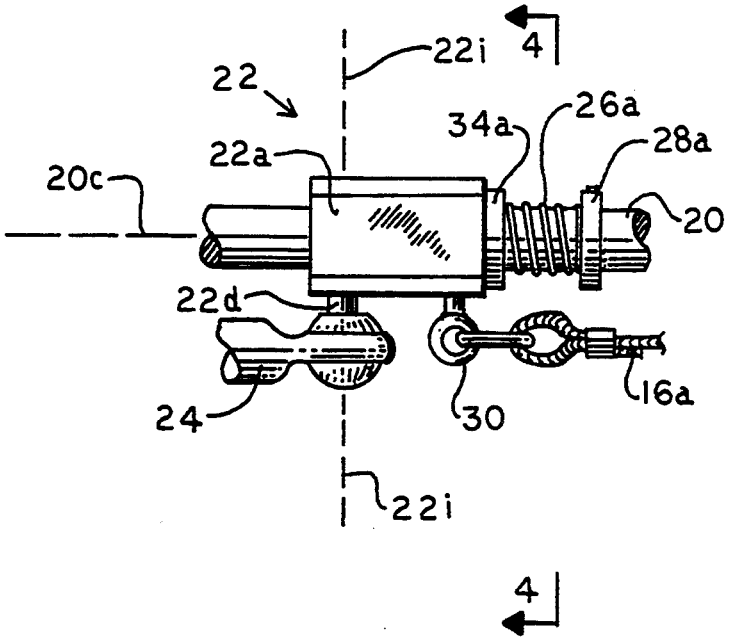
FIG. 3 is an enlarged view of a portion of the machine shown in FIG. 2.
Figure 4:
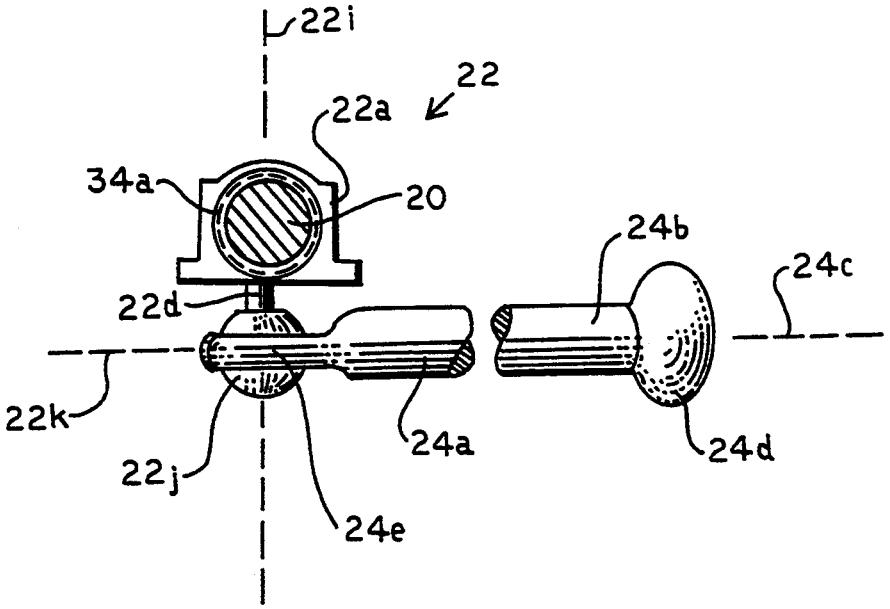
FIG. 4 is a cross-sectional view of the portion of the machine shown in FIG. 3, taken along the cutting line 4—4.

Reference is now made to FIGS. 3 and 4, in which is shown the detailed structure of the kinetic adapter 22.

The kinetic adapter 22 comprises a linear ball bearing 22*a* and a substantially spherical member 22*j* connected to one another by a connecting member 22*d* having a longitudinal axis 22*i*. The rigid cross-member 20 extends through and is rotatably and slidably disposed in the opening in the linear bearing 22*a*.

The first end 24*a* of the training bat 24 includes an annular collar 24*e* conformable to the spherical member, in which the spherical member 22*j* is disposed. Preferably, the annular collar 24*e* circumscribes the circumference 22*k* of the spherical member 22*j*. The internal diameter of the annular collar 24*e* is approximately equal to but slightly greater than the external diameter of the spherical member 22*j*, thereby enabling the collar 24*e* to move freely about the spherical member 22*j* without slipping off the circumference 22*k* of the spherical member 22*j*. The kinetic adapter 22 thus permits for the bat 24 freedom of movement, both linear and rotational, in all directions, in three dimensions, and in an infinite number of planes.

Figure 5:
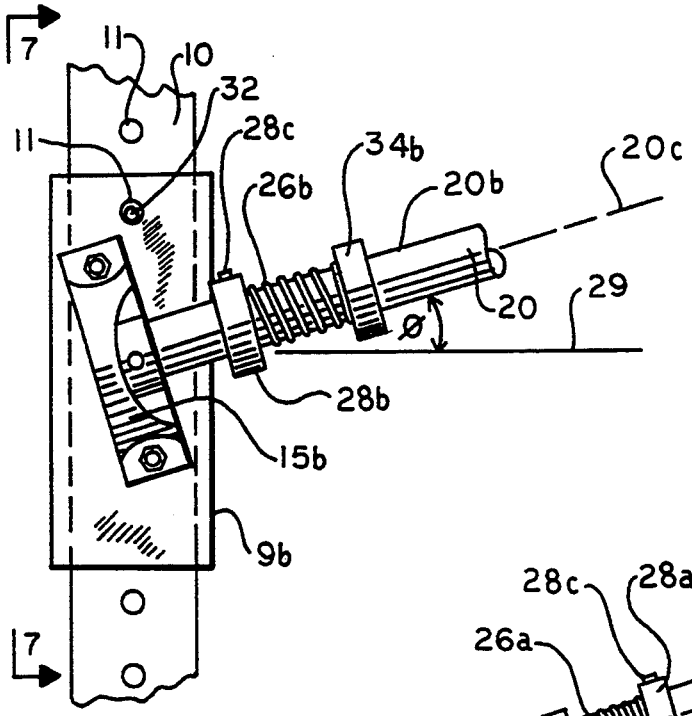
FIG. 5 is an enlarged view of a first portion of the machine shown in FIG. 1.
Figure 6:
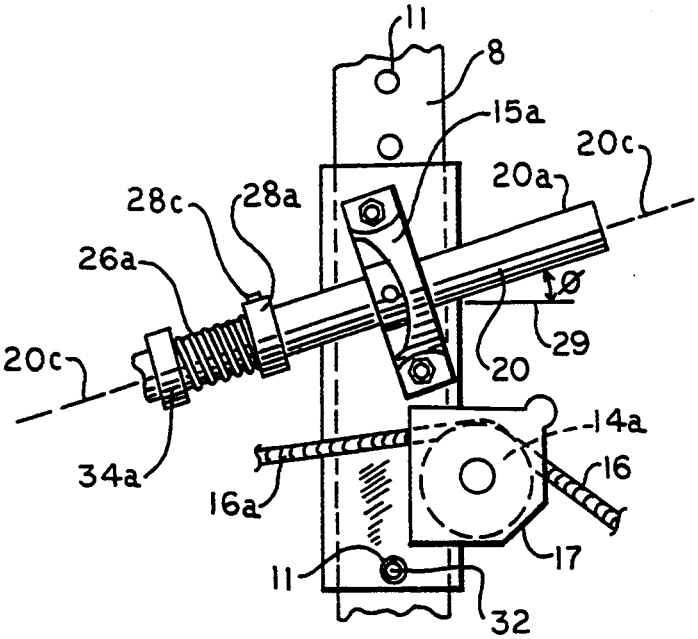
FIG. 6 is an enlarged view of a second portion of the machine shown in FIG. 1.

Reference is now made to FIGS. 5 and 6, in which are shown structural details of portions of the training machine 2.

While the inclination of the adjustable cross-member 20 may be horizontal or oblique, it is preferably oblique with a slight downward slope from the first vertical member 8 to the second vertical member 10, as shown in FIGS. 5 and 6. The adjustable cross-member 20 defines an angle $\Theta$ with a horizontal plane 29. The value of $\Theta$ is from about forty degrees above the horizontal plane 29 to about forty degrees below the horizontal plane 29. Preferably, the value of $\Theta$ is from about twenty degrees above to about twenty degrees below the horizontal plane 29.

Figure 7:
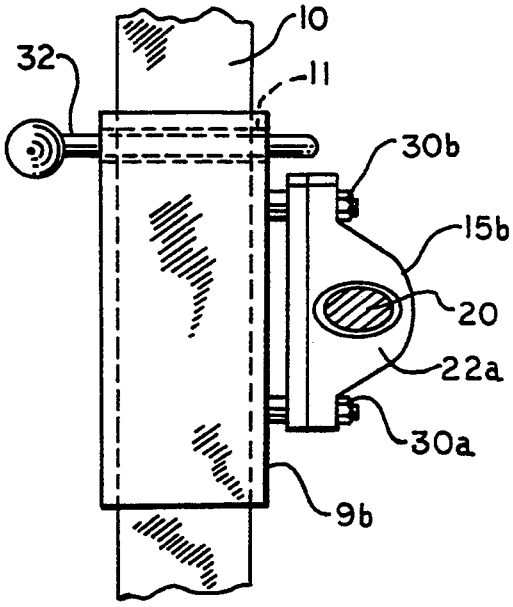
FIG. 7 is a cross-sectional view of the first portion of the machine shown in FIG. 5, taken along the cutting line 7—7.

Reference is now made to FIG. 7, in which are shown structural details of the manner of attachment of the second sheath 9*b* to the second vertical member 10. The elevation of the second sheath 9*b* is fixed by inserting a pin 32 through the aligned perforations 11 of the sheath 9*b* and the vertical member 10. In a similar manner the elevation of the first sheath 9*a* is fixed by inserting a second pin 32 through the aligned perforations 11 of the sheath 9*a* and the first vertical member 8. These two operations fix both ends 20*a*, 20*b* of the longitudinal cross-member 20.

The length of the training bat 24 is from about twenty-eight to about thirty-eight inches, in order to simulate a regulation baseball bat, which has a length of thirty-four inches. Preferably, the length of the training bat 24 is from about thirty-two to about thirty-six inches.

The length of the adjustable cross-member 20 is from about three to about five feet.

The length of the vertical members 8 and 10 is from about four to about six feet.

Preferably, the vertical members 8 and 10 and the sheaths 9*a* and 9*b* are made from tubing. Even more preferably, they are made from square tubing.

The dimensions of the pillow block bearings 15*a* and 15*b* are preferably about one inch internal diameter (1" ID).

The perforations 11 in the sheaths 9*a*, 9*b* and the vertical members 8, 10 are from about three-eights to about thee-fourths of an inch in width. Preferably, the perforations 11 are from about three-eighths to about one-half of an inch in width. Most preferably, the perforations 11 are substantially circular.

The distance separating the individual perforations 11 from one another is from about three-fourths of an inch to about one and one-half inches.

The manner of operating and using the training machine 2 is generally as follows.

The trainee grasps the handle 24*b* of the training bat 24, and starts his or her swing. The start of the swing is determined by the position of the third stop member 34*a*. From this starting position, the kinetic adapter 22 travels on a path along the adjustable cross-member 20 until the adapter 22 strikes and is stopped by the fourth stop member 34*b*, the second spring 26*b*, and the second stop member 28*b*, thereby ending the swing. This procedure eliminates the need for a totally separate drill in which a baseball trainee hits a tire with a baseball bat.

Apparatus and method for measuring the speed of the trainee's swing are disclosed in U.S. Pat. Nos. 5,226,646 and 5,228,684, which have been incorporated by reference.

Apparatus and method for measuring and for increasing the force and power of the swing are disclosed in U.S. Pat. No., 5,226,646, which has been incorporated by reference.

While the apparatus and method just described are clearly applicable to the sports of baseball, lawn tennis, table tennis, badminton, racquetball, and handball, it will be apparent to those skilled in the art that by mounting the kinetic adapter 22 on a substantially vertical support shaft rather than on the substantially horizontal support shaft 20, the training machine 2 can be modified to function as a machine for training a person to swing a golf club and hit a golf ball in the most effective and efficient manner, thereby extending the scope of the training machine and method of the present invention to include the sport of golf.

I claim:

1. A kinetic adapter mounted on a stationary shaft, for providing freedom of movement for a rigid, elongated member, the adapter comprising:

(a) A linear bearing having an opening therein extending therethrough, the stationary shaft being disposed within and extending through the opening in the linear bearing, whereby the linear bearing is slidably and rotatably mounted on the stationary shaft;

(b) a second shaft having first and second ends, the first end of the second shaft being fastened to the linear bearing in an orientation such that the stationary shaft and the second shaft are substantially perpendicular to one another; and (c) a spherical member connected to the second end of the second shaft; the rigid, elongated member having first and second ends, the first end of the rigid, elongated member being rotatably connected to the spherical member, and the second end of the rigid, elongated member being free, to serve s a handle for grasping and moving the rigid, elongated member; the stationary shaft, the linear bearing, the second shaft, the spherical member, and the rigid, elongated member being so constructed and arranged that the combination thereof provides for the rigid, elongated member freedom of movement, both linear and rotational, in three dimensions and an infinite number of planes.

2. The kinetic adapter of claim 1, wherein the first end of the elongated member includes an annular collar in which the spherical member is disposed.

3. A training machine for baseball, lawn tennis, table tennis, badminton, racquetball, and handball, the machine comprising:

(a) a frame;

(b) a first rigid elongated member having first and second ends and a longitudinal axis, the first elongated member being secured to the frame, the first elongated member being entirely straight and substantially horizontal;

(c) a linear bearing having an opening therein extending therethrough, the first elongated member being disposed within and extending through the opening in the linear bearing, whereby the bearing and the first elongated member are constructed and arranged so that the bearing can move linearly along the first elongated member and rotatably around the longitudinal axis of the first elongated member; the first elongated member thus providing a constrained, entirely straight path for movement of the linear bearing;

(d) a straight second rigid elongated member having first and second ends and a longitudinal axis, the first end of the second elongated member being fastened to the linear bearing in an orientation such that the longitudinal axes of the first and second elongated members are substantially perpendicular to one another;

(e) a spherical member connected to the second end of the second elongated member; and (f) a training bat having first and second ends, the first end of the bat serving as a bathead and the second end of the bat serving as a handle, the first end of the training bat being rotatably connected to the spherical member;

whereby the bathead is constrained by the linear bearing to move in an entirely straight path when the bat is swung.

4. The training machine of claim 3, wherein (g) the first end of the training bat forms an annular collar in which the spherical member is disposed.

5. The training machine of claim 3, further comprising:

(g) a weight, for providing a resistance to swinging the training bat;

(h) a cable having first and second ends, the first end of the cable being connected to the linear bearing, the second end of the cable being connected to the weight;

(i) an electrical timer;

(j) a magnet attached to the weight;

(k) a first electromagnetic sensor; and (l) a second electromagnetic sensor;

the timer, the first electromagnetic sensor, and the second electromagnetic sensor being electrically connected to one another; and the timer, the magnet, and the first and second electromagnetic sensors being constructed and arranged so that a first electrical signal is emitted when the magnet passes near the first electromagnetic sensor, and a second electrical signal is emitted when the magnet passes near the second electromagnetic sensor, the first signal starting the timer and the second signal stopping the timer, the difference hereby obtained measuring the elapsed time, from which the speed of the swing can be calculated, and the magnitude of the weight determining and measuring the force of the swing, the speed and force of the swing providing a computed measurement of the power of the swing.

* * * * *